US009670600B2

(12) United States Patent
Schäffler et al.

(10) Patent No.: US 9,670,600 B2
(45) Date of Patent: Jun. 6, 2017

(54) SPINNING UNIT OF AN AIR JET SPINNING MACHINE AND ITS OPERATION

(71) Applicant: Maschinenfabrik Rieter AG, Winterthur (CH)

(72) Inventors: Gernot Schäffler, Wäschenbeuren (DE); Jörg Hehl, Leinfelden (DE); Andreas Fischer, Steckborn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 82 days.

(21) Appl. No.: 14/710,814

(22) Filed: May 13, 2015

(65) Prior Publication Data

US 2015/0329994 A1 Nov. 19, 2015

(30) Foreign Application Priority Data

May 13, 2014 (CH) ..... 0716/14

(51) Int. Cl.
*D01H 4/02* (2006.01)
*D01H 4/08* (2006.01)
(Continued)

(52) U.S. Cl.
CPC ..... *D01H 4/02* (2013.01); *D01H 1/115* (2013.01); *D01H 4/08* (2013.01); *D01H 4/34* (2013.01); *D01H 13/306* (2013.01)

(58) Field of Classification Search
CPC ..... D01H 4/02; D01H 13/304; D01H 13/306
See application file for complete search history.

(56) References Cited

U.S. PATENT DOCUMENTS 3,783,596 A * 1/1974 Waldkirch ..... D06B 1/08 28/272
4,064,684 A * 12/1977 Nijhuis ..... D01H 1/115 57/296
(Continued)

FOREIGN PATENT DOCUMENTS

EP 1 072 702 A2 1/2001
EP 2 450 478 A2 5/2012
(Continued)

OTHER PUBLICATIONS

Swiss Patent Office Search Report, Aug. 22, 2014.
EP Search Report, Oct. 6, 2015.

*Primary Examiner* — Shaun R Hurley
(74) *Attorney, Agent, or Firm* — Dority & Manning, P.A.

(57) ABSTRACT

A spinning unit is provided for an air jet spinning machine with a spinning nozzle used to manufacture yarn from a fiber strand. The spinning nozzle has an inlet for the fiber strand, a vortex chamber, a yarn forming element protruding into the vortex chamber, and a draw-off channel for the yarn. An additive supply is assigned to the spinning nozzle and designed so that the spinning nozzle is supplied with an additive. The yarn forming element has at least one additive duct that ends in the vortex chamber or the draw-off channel. The additive supply encompasses an additive supply line connected to the additive duct so that an additive introduced into the additive duct via the additive supply line can be introduced into the draw-off channel and/or the vortex chamber. A process for operating an air jet spinning machine with at least one spinning unit is provided. An additive is added, at least intermittently, to the spinning nozzle of the spinning unit while it is operating with the help of an additive supply. The added additive is delivered through an additive duct of the yarn forming element to the draw-off channel and/or the vortex chamber.

15 Claims, 6 Drawing Sheets

(51) Int. Cl.

| | |
|---|---|
| ***D01H 4/34*** | (2006.01) |
| ***D01H 1/115*** | (2006.01) |
| ***D01H 13/30*** | (2006.01) |

(56) References Cited

U.S. PATENT DOCUMENTS

| | | | | |
|---|---|---|---|---|
| 5,193,335 | A * | 3/1993 | Mori | D01H 1/115 57/296 |
| 6,513,315 | B1 | 2/2003 | Alavoine et al. | |
| 9,290,863 | B2 * | 3/2016 | Gotz | D01H 1/115 |
| 2008/0072562 | A1 | 3/2008 | Wust et al. | |
| 2008/0190089 | A1 | 8/2008 | Stahlecker et al. | |
| 2012/0192541 | A1 | 8/2012 | Artzt et al. | |

FOREIGN PATENT DOCUMENTS

| | | | |
|---|---|---|---|
| EP | 2 620 532 | A1 | 7/2013 |
| FR | 2 704 005 | A1 | 10/1994 |
| JP | 2008095208 | | 4/2008 |

* cited by examiner

SPINNING UNIT OF AN AIR JET SPINNING MACHINE AND ITS OPERATION

FIELD OF THE INVENTION

The present invention refers to a spinning unit of an air jet spinning machine with a spinning nozzle to manufacture yarn from a fiber strand fed to the spinning nozzle, wherein the spinning nozzle has an inlet for the fiber strand, an internally located vortex chamber, a yarn forming element protruding into the vortex chamber and a draw-off channel for the yarn forming element containing the yarn as well as an outlet for the yarn produced inside the spinning nozzle. In addition, a process for operating an air jet spinning machine with at least one spinning unit is suggested, wherein the spinning unit has at least one spinning nozzle and a fiber strand is fed to the spinning nozzle through an inlet while the spinning unit is being operated, and a twist is imparted to the fiber strand in the area of a yarn forming element protruding into a vortex chamber of the spinning nozzle, so that a yarn is formed from the fiber strand exiting the yarn forming element through a draw-off channel and finally comes out through an outlet.

BACKGROUND

Air jet spinning machines equipped with the corresponding spinning units are known from the state of the art and serve to manufacture yarn from an elongated fiber strand. In this process, the outer fibers of the fiber strand are wound around the inner core fibers with the help of a swirled air current generated by the air nozzles inside the vortex chamber in the area of a fiber inlet of the yarn forming element and finally form the wrap fibers crucial for desired yarn strength. As a result of that, a yarn with a real yarn twist is formed that is finally led out of the vortex chamber via a draw-off channel and can be wound up around a tube, for example.

Generally, within the meaning of the invention, the term yarn is understood to be a fiber strand in which at least some of the fibers are wound around an inner core. Thus, the term encompasses a yarn in the conventional meaning that can be processed into a fabric, for example, with the help of a weaving machine. However, the invention also refers to air jet spinning machines used to manufacture so-called rove (another name: sliver). This kind of yarn is characterized by being capable of drafting in spite of having certain strength sufficient for transporting the yarn to a subsequent textile machine. Thus, the rove can be drafted with the help of a drafting mechanism (e.g. the drafting system, a textile machine that processes the rove such as a ring spinning machine) before it is finally spun.

In the manufacturing of synthetic fibers such as polyester or a combination of natural and synthetic fibers, deposits are formed on the surface of the yarn forming element. The manufacturing of synthetic fibers encompasses a so-called preparation of the continuous filaments during the manufacturing process. The preparation consists of applying a preparation agent (generally oils with various additives) to allow treatment that can involve drafting the continuous filaments under high rates. These preparation agents continue to adhere partially on the synthetic fibers even in further processing and cause impurities in the air jet spinning machine. The fibers fed to the air jet spinning machine in the form of a fiber strand are generally supplied by a pair of delivery rollers of the spinning nozzle. The pair of delivery rollers can correspond to a front roller pair of a drafting system, which is used to improve the fiber strand presented before it enters the spinning nozzle.

As a rule, a fiber guiding element is arranged in the inlet area of the spinning nozzle through which the fiber strand is guided into the spinning nozzle and finally into the area of the yarn forming element. Spindles having an inner draw-off channel are used most of the time as yarn forming elements. Compressed air is introduced in such a way on the top of the yarn forming element through the housing wall of the spinning nozzle that the above-mentioned rotating swirled air current is generated. This causes the individual outer fibers coming out of the fiber guiding element to be separated and turned over above the tip of the yarn forming element. Later, these detached fibers rotate on the surface of the yarn forming element. Subsequently, the forward movement of the inner core fibers of the fiber strand makes the rotating fibers wind around the core fibers, thus forming the yarn. However, the movement of the individual fibers over the surface of the yarn forming element also causes deposits to form on the yarn forming element owing to adhesions on the fibers from the manufacturing process. Deposits on the yarn forming element can also be caused by damaged fibers. For the same reasons, deposits can also form on the surface of the spinning nozzle's interior. These adhesions are detrimental to the surface finish of the yarn forming element and lower the quality of the manufactured yarn. Therefore, regular cleaning of the affected surfaces becomes necessary to maintain the same quality of the spun yarn.

The surfaces of the yarn forming element can be cleaned manually by periodically disassembling the yarn forming element, but this involves significant maintenance work coupled with the corresponding operational downtime.

On the other hand, EP 2 450 478 describes an equipment capable of cleaning the machine automatically without shutting down the machine. To accomplish this, an additive is added to the compressed air used inside the spinning nozzle for producing the swirled air current. The additive is guided through the compressed air towards the yarn forming element, where it cleans its surface.

Another embodiment to clean the yarn forming element is described in JP-2008-095-208. Here, an additive is likewise fed to the compressed air used for swirling in the spinning nozzle that guides it to the spinning nozzle and thus to the yarn forming element. In the disclosed embodiment, the dosage and addition of the additive is intended to be separate for each spinning unit.

The disadvantage of these disclosed cleaning systems is that the additive dosage depends on the supply of compressed air to the air nozzles. Thus, a dosage independent of this is not possible.

In principle, the same problem occurs when an additive should be added to the fiber strand in order to improve the properties of the yarn manufactured in this way, for example with regard to its hairiness or strength, since in this case the dosage can be regulated in an especially precise way to prevent that too much or too little of the prescribed quantity of additive is applied on the individual fiber strand sections.

SUMMARY OF THE INVENTION

A task of the present invention is therefore to provide a solution that allows an especially constant and exactly regulated supply of the spinning nozzle with additive. Additional objects and advantages of the invention will be set forth in part in the following description, or may be obvious from the description, or may be learned through practice of the invention.

The tasks are solved by a spinning unit of an air jet spinning machine and a process having the characteristics described and claimed herein.

According to the invention, the spinning unit is characterized by having an additive supply assigned to it and designed to supply the spinning nozzle with an additive. The additive supply encompasses at least one additive supply line that is fluidically connected to an additive duct of the yarn forming element. The additive duct ends in the vortex chamber of the spinning nozzle or in the draw-off channel of the yarn forming element, so that an additive introduced into the additive duct via the additive supply line can be introduced into the draw-off channel and/or the vortex chamber.

The result is that the additive can now be introduced into the vortex chamber regardless of the compressed air supplied by the air nozzles, making it possible to supply an exact dose of the additive. Preferably, the additive duct of the yarn forming element ends in the area of the draw-off channel, i.e., it has an additive discharge opening located in the inner wall area of the draw-off channel. In this case, the imaginary extension of a middle axis of the additive duct intersects preferably with the middle axis of the draw-off channel. It is especially advantageous if the additive duct ends in the draw-off channel, in the area of a tip or fiber inlet opening of the yarn forming element and oriented obliquely against the inlet direction of the fibers in the draw-off channel, in which case the draw-off channel and the additive duct can be executed as a bore (at least partially).

Incidentally, the additives used can be liquids, solids or mixtures thereof, but water or an aqueous solution is preferred.

So that the quantity of the delivered additive can be regulated, it is also advantageous if the additive supply—especially the additive supply line—is equipped with a dosing device for regulating the volumetric flow and/or mass flow of the additive being delivered via the additive duct. The dosing device can be a valve or a dosing pump regulated manually or through a control mechanism so the quantity of additive passing through the pump or dosing pump can be controlled, in which case the valve or dosing pump is integrated into the additive supply line, for example. Alternately or additionally, the quantity of additive being supplied can also be controlled by adjusting the negative pressure prevalent in the vortex chamber. The negative pressure is generated by a negative pressure source connected to the vortex chamber.

It is also advantageous if the additive duct (or at least some sections thereof) runs inside the yarn forming element. For example, it could be conceivable to execute the additive duct as a bore that penetrates the yarn forming element or its front area having the fiber inlet opening from the outside to the draw-off channel (in which case, more than one additive duct could be generally present). Likewise, the additive duct can consist of several interconnected sections. It could be conceivable, for example, for the yarn forming element to have a base body and a tip fixed to the base body and the above-mentioned fiber inlet opening. In this case, the draw-off channel could be made up of a bore arranged inside the tip and an additional section running inside the base body (although this section could also be formed by a bore). In this case, a preferably annular transition section of the additive duct surrounding the draw-off channel could be located in the transitional area between base body and tip, in which both the duct section of the tip and the duct section of the base body end. This could finally have the advantage that both duct sections are always connected through the transitional section regardless of whether the tip is twisted around the middle axis of the draw-off channel.

It is additionally advantageous if the additive duct encompasses with the draw-off channel (especially with its corresponding middle axis) an angle (at least in sections) of 3° to 12°, preferably of 5° to 10°. The additive duct is also oriented preferably against the yarn's transportation direction inside the draw-off channel, so that the additive is delivered (obliquely) against the above-mentioned transportation direction in the draw-off channel and, while doing so, makes contact with the fibers of the supplied fiber strands or yarn. Finally, it is advantageous if at least some sections of the additive duct and draw-off channel lie on a common plane.

It is advantageous if the additive duct ends in the draw-off channel, in an area of a fiber inlet opening of the yarn forming element. In this case, the additive also reaches the area of the outer surface of the yarn forming element and can thus serve to clean this surface (in this case, the negative pressure prevalent in the vortex chamber, which is generated therein when the spinning nozzle is operated by an air exhaust, transports the additive from the draw-off channel and hence from the interior of the yarn forming element in the area of its outer surface). In particular, the additive duct should end in the draw-off channel in such a way that the resulting connection area of additive duct and draw-off channel is less than 10 mm, preferably less than 5 mm, away from the fiber inlet opening of the yarn forming element.

It is likewise advantageous if the additive duct runs, at least partially, inside a wall of the yarn forming element surrounding the draw-off channel and ends in a discharge opening located in the outer surface area of the yarn forming element. In this case, the additive duct does not change gradually into the draw-off channel. Rather, the above-mentioned discharge opening is found preferably in the outer area of the front area of the yarn forming element or its tip that has the fiber inlet opening. Here, the additive is applied directly on the area of the outer surface of the yarn forming element, which during yarn manufacturing makes contact with the fiber ends looped around the inner core of the supplied fiber strands in the fiber inlet opening area of the yarn forming element. Here, the additive also makes contact with the fibers of the outer surface of the yarn forming element, so that—depending on how much additive is added—yarn quality is improved and/or the yarn forming element is cleaned.

It is additionally advantageous if the additive duct is also fluidically connected with a compressed air line of the spinning unit, so that the compressed air introduced through the compressed air line can be introduced into the draw-off channel and/or vortex chamber via the additive duct. The introduction of compressed air is especially advantageous during a piecing process on the corresponding spinning unit, in which the end of a yarn is introduced against the transportation direction prevailing in the spinning operation through the outlet of the spinning nozzle in the draw-off channel. The compressed air introduced via the additive duct generates in this case an air current inside the draw-off channel directed towards its fiber inlet opening. The introduced yarn end, coming preferably from a bobbin, is captured by the above-mentioned air current during the piecing process and transported through the draw-off channel. After the yarn end exits the draw-off channel via the fiber inlet opening, it can finally be transported outside via the spinning nozzle inlet (this is also supported by the air current mentioned above, however) and joined to a final section of a fiber strand. Finally, the previously deactivated air nozzles of the spinning nozzle are once again impinged with compressed air and the supply of compressed air coming through the additive duct is stopped, so that the yarn end joined to the fiber strand (and thereby the fiber strand too) reaches the vortex chamber in transportation direction and the spinning operation can resume.

It is especially advantageous if at least one valve is assigned to the compressed air line and/or the additive supply line that can have two different valve positions, whereby the additive duct is fluidically connected either to the compressed air line or the additive supply line depending on the position of the valve. While the first position can be selected over the course of the piecing process mentioned above, additives can be supplied to the spinning nozzle in the second position and this is advantageous in the spinning operation that follows the piecing process. It could be possible to move the valve manually, for example.

It is likewise extremely advantageous if the valve is connected to a control mechanism designed to keep the valve in its first position, at least part of the time, while the spinning unit is being operated. In this position, the additive duct is fluidically connected to the additive supply line. Likewise, the control mechanism should be executed so the valve can be kept in its second position, at least part of the time, during a piecing process of the spinning unit. In this position, the additive duct is fluidically connected to the compressed air line. In this case, the control mechanism selects the valve position automatically so that additives are only supplied to the spinning nozzle when no piecing process is being carried out and vice versa.

The process according to the invention is characterized by the fact that an additive is supplied to the spinning nozzle of the respective sir jet spinning machine while the spinning unit is in operation, at least part of the time, with the help of an additive supply, in which case the added additive is delivered through an additive duct of the yarn forming element in the draw-off channel and/or the vortex chamber. Regarding possible physical features of the air jet spinning machine or its components, refer to the previous or following description. The process can be used in an air jet spinning machine that has one or several of the corresponding features. In particular, different additives can be used depending on the application, but reference is also made here to the description given below. In any case, according to the present invention, the additive is introduced to the spinning nozzle regardless whether during spinning the compressed air is introduced to the spinning nozzle through the air nozzles of the respective spinning nozzle, so that the additive doses can be delivered regardless of the air pressure of the compressed air mentioned above.

It is especially advantageous if during the operation of the spinning unit additives can be delivered, at least part of the time, through the additive duct, and when during a piecing process of the spinning unit compressed air is delivered through the additive duct, at least part of the time. In this case, the additive duct is used either for delivering the additive or compressed air. The delivery of compressed air allows a return of a yarn end from the outlet of the spinning nozzle to an area arranged upstream from the inlet of it. It is especially advantageous if either additives or compressed air is/are delivered via the additive duct depending on the spinning unit's mode of operation.

It is advantageous if the additive duct is fluidically connected with the additive supply line and a compressed air line. In addition, at least one valve should be assigned to the additive supply line and/or the compressed air line, in which case the valve is kept, at least part of the time, in a first position in which the additive duct is fluidically connected to the additive supply line, with the help of a control mechanism while the spinning nozzle is in operation. As an alternative to this, the control mechanism should keep the valve, at least part of the time, in a second position in which the additive duct is fluidically connected to the compressed air line during a piecing process of the spinning nozzle. The position of the corresponding valve is therefore regulated by the control mechanism, thus allowing an automatic operation of the valve.

It is especially advantageous if the volumetric and/or mass flow of the additive delivered through the additive duct is regulated with the help of a dosing device, which can be a valve or dosing pump, for example, and the valve could be moved to several positions. For more possible details of the dosing device, consult the description given below.

It is likewise advantageous if the volumetric flow rate of the delivered additive reaches, at least part of the time, between 0.001 mL/min and 7.0 mL/min, preferably between 0.01 mL/min and 5.0 mL/min, very preferably between 0.05 and 3.0 mL/min, and/or when the mass flow of the added additive reaches, at least part of the time, a rate between 0.001 g/min and 7.0 g/min, preferably between 0.01 g/min and 5.0 g/min, very preferably between 0.05 g/min and 3.0 g/min. While higher values (during the cleaning operation) allow the yarn forming element of the spinning nozzle to be cleaned, lower values are advantageous during spinning because the additive serves merely to improve yarn properties. Therefore, a dosing device that delivers the additive should allow the regulation of the volumetric or mass flow over the above-mentioned ranges so the individual spinning nozzles can be operated both during their normal and cleaning operation.

In this context, It is advantageous if the volumetric flow (or mass flow) of the additive added during the normal operation of the air jet spinning machine reaches a value between 0.001 mL/min (or g/min) and 1.5 mL/min (or g/min), preferably between 0.01 mL/min (or g/min) and 1.0 mL/min (or g/min) and the volumetric flow (or mass flow) of the additive added during a cleaning operation of the air jet spinning machine reaches a value between 2.0 mL/min (or g/min) and 7.0 mL/min (or g/min), preferably between 3.0 mL/min (or g/min) and 7.0 mL/min (or g/min).

The exact value can be selected from the spinning unit depending on the properties of the fiber strand and/or its feeding speed in the spinning unit and/or the yarn's reeling speed and can therefore fluctuate depending on the individual application. Likewise, the value can be selected between two cleaning steps depending on how long the cleaning or normal operation lasts.

BRIEF DESCRIPTION OF THE DRAWINGS

Additional advantages of the inventions are described in the following embodiments, which show.

DETAILED DESCRIPTION

Figure 1:
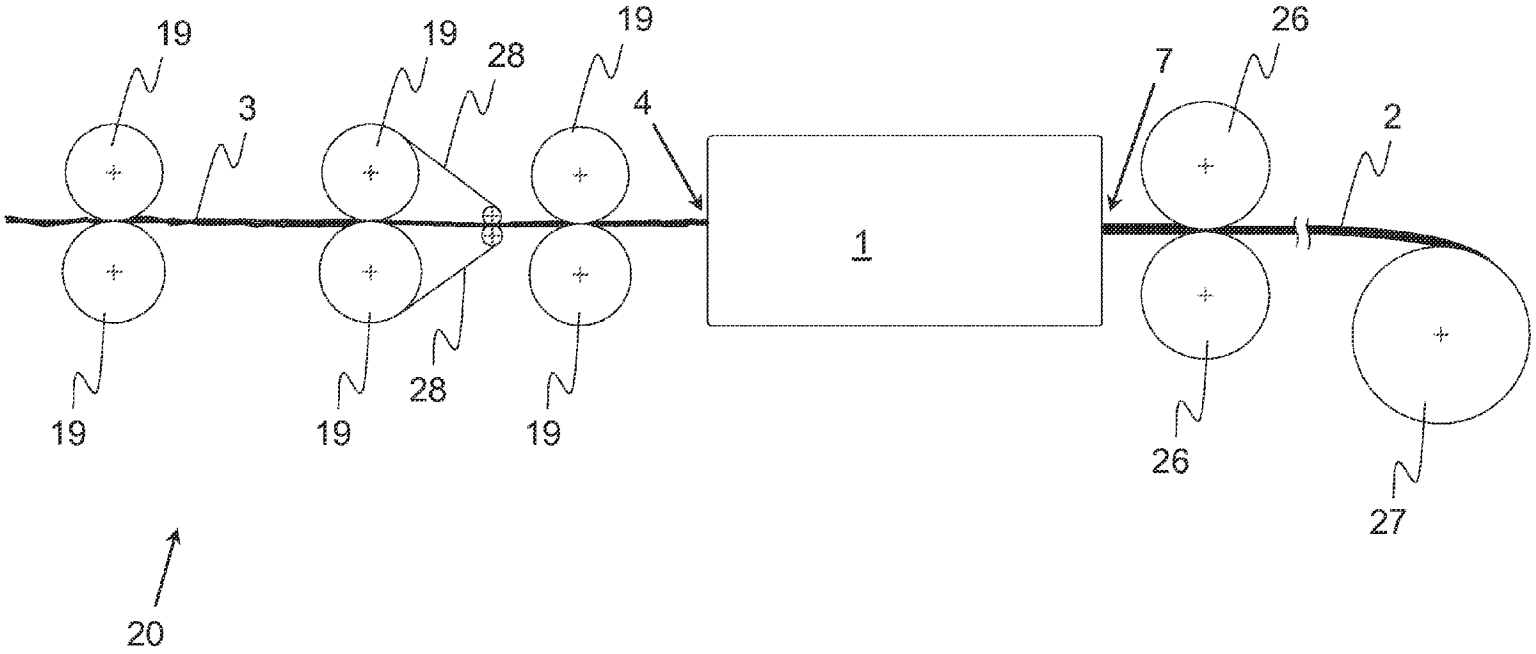
FIG. 1 a section of a spinning unit of an air jet spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a section of a spinning unit of an air jet spinning machine according to the invention (needless to say, the air jet spinning machine can have many spinning units preferably arranged next to one another). If necessary, the air jet spinning machine can encompass a drafting system 20 with several drafting system rollers 19 (which can be partially entwined with an apron 28) delivered with a fiber strand 3 in form of a doubled draw frame sliver. Furthermore, the spinning unit shown in more detail in FIG. 2 encompasses a spinning nozzle 1 with a vortex chamber 5 arranged inside, in which the fiber strand 3 or at least some of the fibers of the fiber strand 3 are imparted a twist after passing an inlet 4 of the spinning nozzle 1 (the precise mode of action of the spinning nozzle 1 will be described in more detail below).

In addition, the air jet spinning machine can encompass a pair of draw-off rollers downstream from the spinning nozzle 1 with two draw-off rollers 26 and a winding device 27 downstream from the draw-off roller pair for spooling the yarn 2 that leaves the spinning unit on a tube. The spinning unit according to the invention must not necessarily have a drafting system 20. The draw-off roller pair is not absolutely necessary either.

The shown spinning unit works generally according to an air spinning process. To form the yarn 2, the fiber strand 3 is guided with a fiber guiding element 18 through an inlet opening of the inlet 4 mentioned above into the vortex chamber 5 of the spinning nozzle 1, where a twist is imparted to it, i.e. at least a few of the free fiber ends of the fiber strand 3 are grasped by the vortex air flow generated by air nozzles 22 arranged in a vortex chamber wall surrounding the vortex chamber 5 (the air nozzles 22 can be connected to one another by means of an air supply duct 23 that is, in turn, connected to a compressed air line 25 supplied with compressed air via a compressed air supply 29; compare also FIG. 6 and the associated description).

Here, some of the fibers are pulled out of the fiber strand 3, at least to some extent, and wound around the front area of a yarn forming element 6 protruding into the vortex chamber 5. Owing to the fact that the fiber strand 3 is drawn from the spinning nozzle 1 through a fiber inlet opening 32 of the yarn forming element 6 via a draw-off channel 24 arranged inside the yarn forming element 6 from the vortex chamber 5 and finally through an outlet 7 from the spinning nozzle 1, the free fiber ends are finally also pulled towards the fiber inlet opening 32 and in the process twist as so-called wrap fibers around the centrally running core fibers—resulting in a yarn 2 having the desired twist. The compressed air introduced through the air nozzles 22 finally comes out of the spinning nozzle 1 through the draw-off channel 24 and a possibly present air outlet 21, which can be connected to a negative pressure source if necessary.

Generally speaking, it should be clarified here that the manufactured yarn 2 can be basically any fiber strand 3 characterized by the fact that an outer portion of the fibers (the so-called wrap fibers) twists around an inner, preferably untwisted or if necessary twisted portion of the fibers in order to impart the yarn 2 with the desired strength. Thus, the invention also encompasses an air jet spinning machine used to manufacture so-called rove. The rove is a yarn 2 having a relatively low proportion of wrap fibers or a yarn 2 in which the wrap fibers are twisted relatively loosely around the inner core so that the yarn 2 remains capable of being drafted. This becomes decisive when the manufactured yarn 2 should or must be drafted once again in a subsequent textile machine (e.g. a ring spinning machine) with the help of a drafting system be muss so it can be correspondingly processed further.

With regard to the air nozzles 22, it should be mentioned here from a purely precautionary viewpoint that they should generally be aligned in such a way that the air jets emerge with equal alignment in order to generate together an air flow with equal alignment and a direction of rotation. Preferably, the individual air nozzles 22 are here arranged rotationally symmetrical to one another and end tangentially in the vortex chamber 5.

Figure 6:
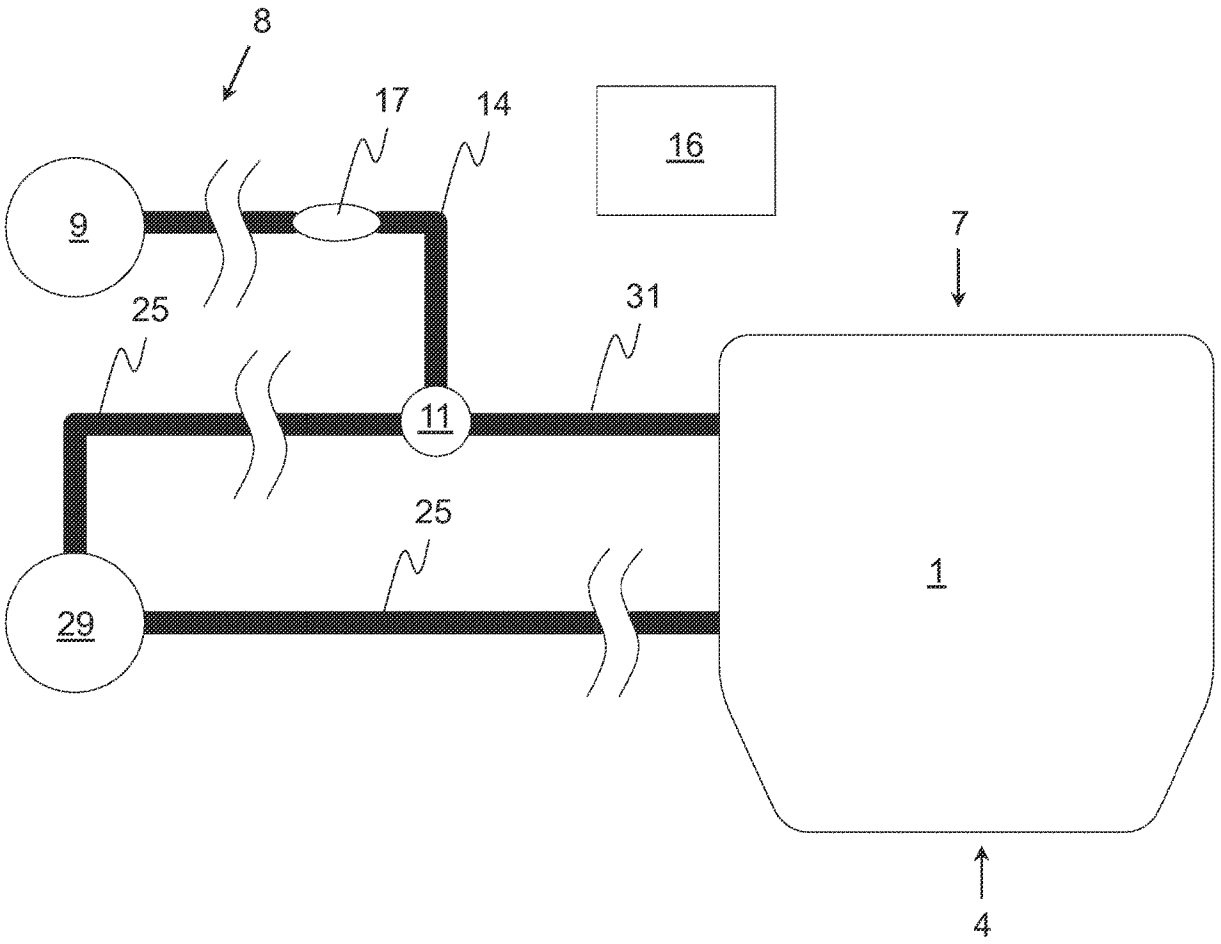

According to the invention, FIG. 6 depicts that an additive supply 8 is assigned to the spinning unit that encompasses one or several additive deposits 9 (for example in form of a pressure container having the additive and a gaseous pressure medium) to provide the additive and one or several, preferably at least partially flexible, additive supply lines 14, through which the corresponding additive deposit 9 is fluidically connected to an additive duct 10 (regarding possible additives, please consult the description given so far).

Figure 3:
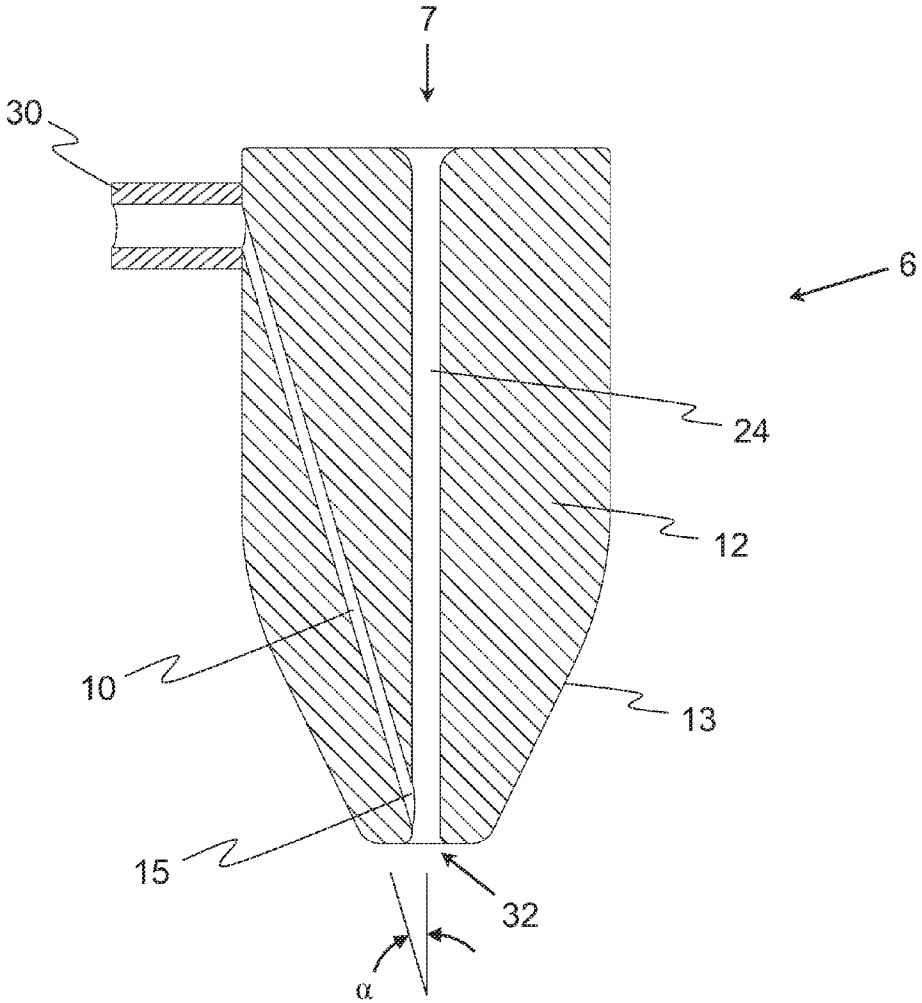
FIG. 3 a yarn forming element of a spinning unit according to the invention, FIG. 4 another embodiment of a yarn forming element of a spinning unit according to the invention, FIG. 5 another embodiment of a yarn forming element of a spinning unit according to the invention, and FIG. 6 a schematic diagram of a section of an air jet spinning machine with a spinning unit according to the invention.

It is furthermore intended for the additive duct 10 mentioned above to extend at least partially inside the yarn forming element 6, in which case the additive duct 10 can be present as a bore, for example. As can be seen in FIG. 3 regarding this, the additive duct 10 can end in the draw-off channel 24 starting from a connection 30 (which is, in turn, fluidically connected to the additive supply line 14), in which case the transition from additive duct 10 in the draw-off channel 24 is arranged preferably in the area of the fiber inlet opening 32 of the yarn forming element 6. Additionally, the angle $\alpha$ between the draw-off channel 24 and the additive duct 10 (merely identified in FIG. 3) should have the magnitude mentioned in the general description. An additive introduced to this area through the additive duct 10 makes contact with the fibers of the yarn 2, thereby improving the quality of the yarn properties (strength, hairiness, etc.). If the quantity of the additive is increased accordingly during the cleaning operation of the spinning nozzle 1, then the additive also reaches the area of the outer surface 13 of the yarn forming element 6 (due to the negative pressure that prevails in the vortex chamber 5) and brings about its cleaning.

Figure 4:
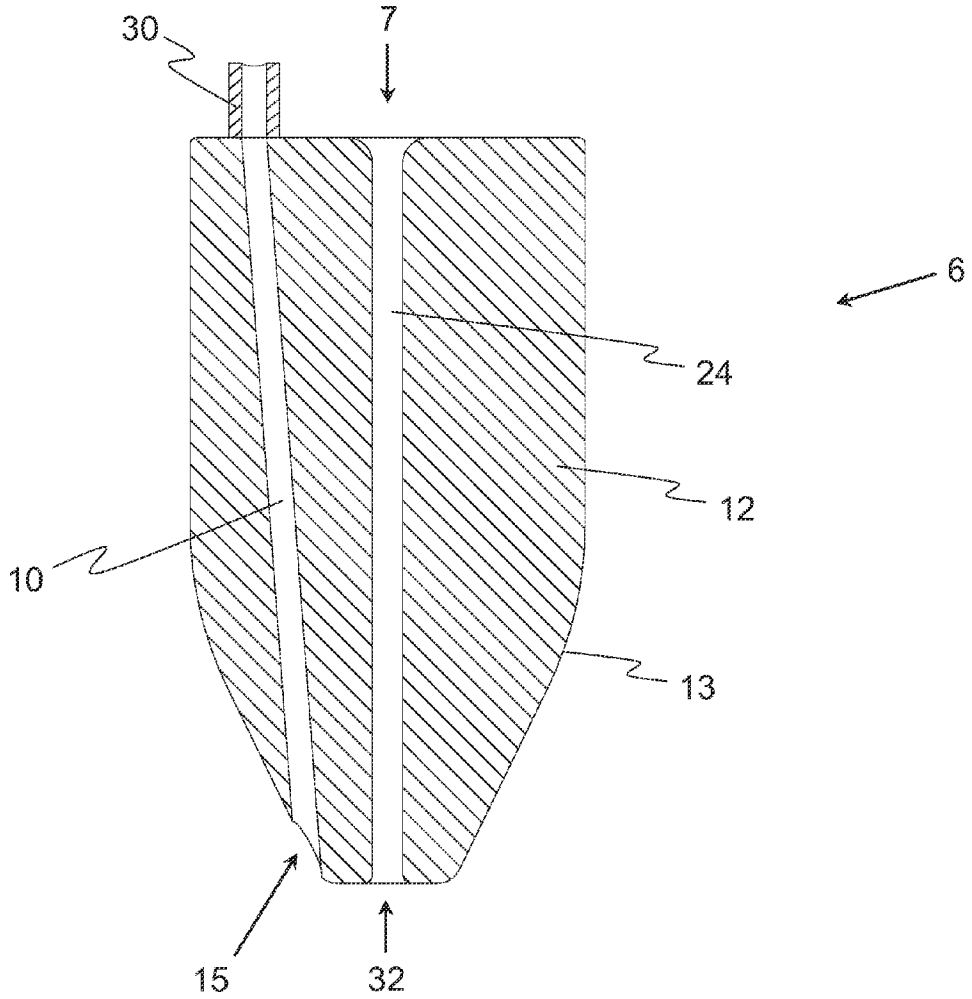

Alternately to the embodiment shown in FIG. 3, it is likewise conceivable for the outlet opening 15 of the additive duct 10 to be arranged in the area of the outer surface 13 of the yarn forming element 6 mentioned above, in which case the additive duct 10 is arranged preferably too in a wall 12 of the yarn forming element 6 that surrounds the draw-off channel 24 (see FIG. 4). In this case also, the additive makes contact with the fibers entering the draw-off channel 24 and in addition very reliably reaches the area of the outer surface 13 of the yarn forming element 6.

Figure 5:
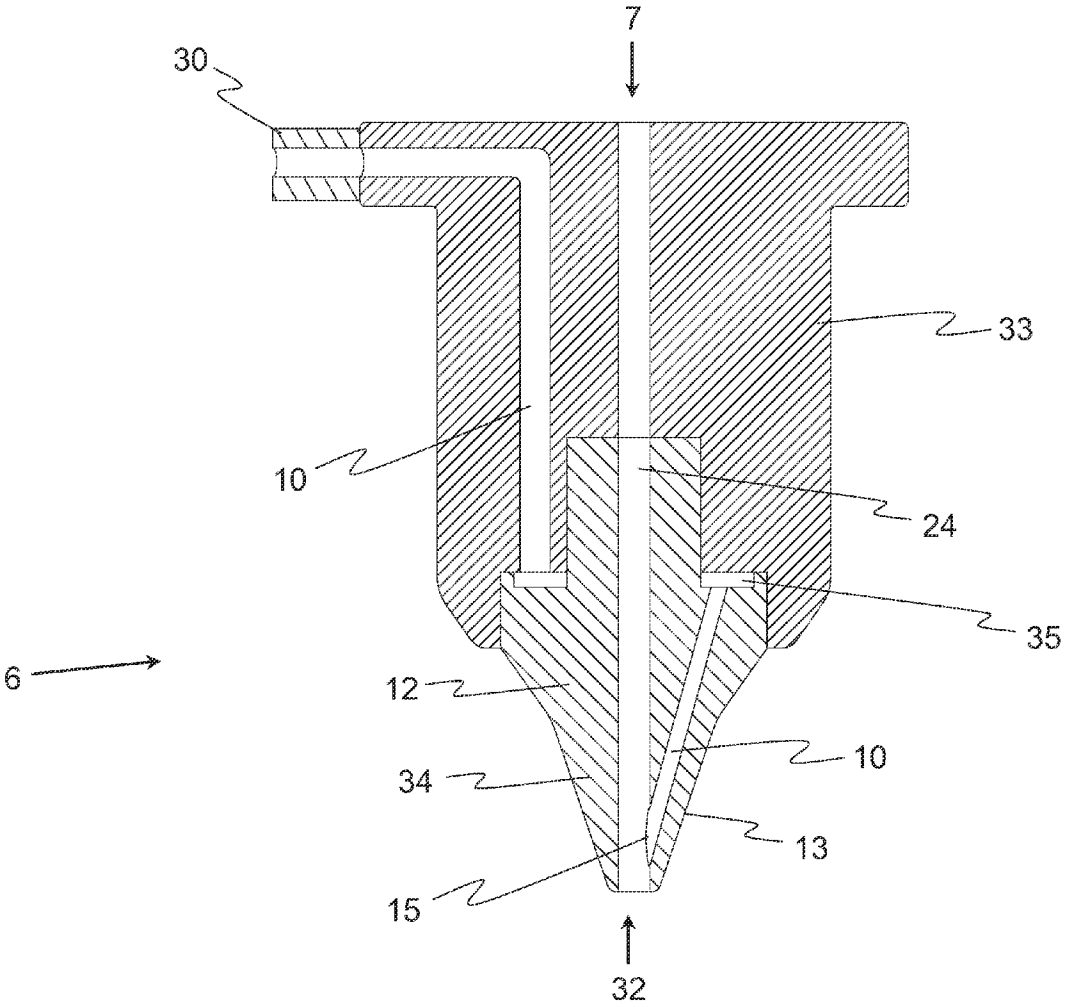

FIG. 5 shows another embodiment of a possible yarn forming element 6. The yarn forming element 6 shown there has several parts, contrary to the one shown in FIGS. 3 and 4. In particular, the yarn forming element 6 encompasses a base body 33 and a tip 34 connected with it (that can be detached, for example). Accordingly, the additive duct 10 also encompasses several sections, in which case a ring-shaped duct 35 can be present in the transitional area between base body 33 and tip 34 to ensure that the sections of the additive duct 10 mentioned above are always fluidically connected regardless of a relative twisting of base body 33 and tip 34.

Figure 2:
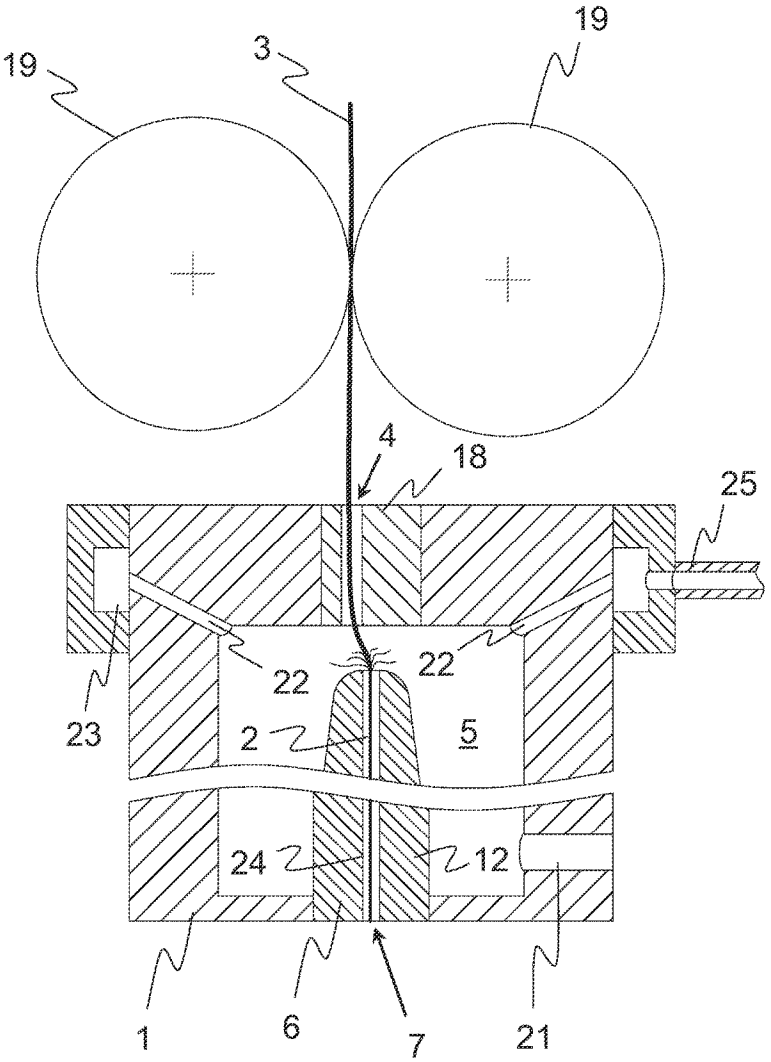
FIG. 2 another section of a spinning unit of an air jet spinning machine.

Finally, FIG. 6 shows a schematic diagram of a section of an air jet spinning machine according to the present invention. As can be seen in this diagram, it is conceivable for a first (in FIG. 6: lower) compressed air line 25 to be present that is connected, on the one hand, with a compressed air supply 29 of the spinning machine and, on the other hand, with the air nozzles 22 of the spinning nozzle 1, as shown in FIG. 2. Finally, the individual air nozzles 22 can be impinged with compressed air via this compressed air line 25 during the spinning operation.

Furthermore, an additive deposit 9 is present, connected fluidically to the connection 30 of the additive duct 10 (shown in FIGS. 3 to 5) through an additive supply line 14, in which case the additive supply line 14 can encompass a dosing device 17 so the volumetric and/or mass flow of the added additive can be regulated (to achieve this, the dosing device 17 can be connected to the control device 16 to allow an automated control).

Additionally, another compressed air line 25 can be present (in FIG. 6: the compressed air supply 29 exiting upwards) that can also be fluidically connected to the connection 30 shown in FIGS. 3 to 5. In this case, the additive duct 10 can also be impinged with compressed air so the piecing process can be carried out.

So it can be determined whether the additive duct 10 can be supplied with compressed air or additive, it finally makes sense to equip the additional compressed air line 25 and the additive supply line 14 with a valve 11 that allows, depending on its setting, a delivery of additive or compressed air to the common supply line 31 that branches off from the valve 11 (in this case, the supply line 31 can be connected to the above-mentioned connection 30). Finally, the control mechanism 16 is used preferably to set the valve position.

The present invention is not restricted to the embodiments shown and described. Modifications within the framework of the invention are just as possible as any combination of the characteristics described, even if they are shown and described in different parts of the description or claims or in different embodiments.

The invention claimed is:

1. A spinning unit for an air jet spinning machine, comprising:

a spinning nozzle configured to manufacture yarn from a fiber strand, the spinning nozzle further comprising:

an inlet for the fiber strand;

an internally located vortex chamber;

a yarn forming element protruding into the vortex chamber and having a yarn draw off channel for the yarn; and an outlet for the produced yarn;

an additive supply in communication with the spinning nozzle to supply the spinning nozzle with an additive;

the yarn forming element further comprising at least one additive duct defined therein that ends in the vortex chamber or the draw off channel, the additive duct oriented obliquely relative to a transport direction of the yarn through the draw off channel; and the additive supply further comprising at least one additive supply line that is fluidically connected to the additive duct, so that an additive introduced through the additive supply line into the additive duct is introduced into one or both of the draw off channel or the vortex chamber.

2. The spinning unit according to claim 1, wherein the additive duct comprises a bore that runs inside the yarn forming element.

3. The spinning unit according to claim 2, wherein the additive duct defines an angle (a) with an axis of the draw-off channel between 3° and 12°.

4. The spinning unit according to claim 2, wherein the additive duct ends in the draw-off channel adjacent to a fiber inlet opening in the yarn forming element.

5. The spinning unit according to claim 2, characterized in that the additive duct ends in an outer surface of a wall of the yarn forming element that surrounds the draw-off channel.

6. The spinning unit according to claim 1, characterized in that the additive duct is also fluidically connected with a compressed air line so that compressed introduced air introduced via the compressed air line is introduced into one or both of the draw-off channel or the vortex chamber through the additive duct.

7. The spinning unit according to claim 6, further comprising a valve in either of the compressed air line or the additive supply line, the valve settable between two different valve positions such that the additive duct is fluidically connected either to the compressed air line or the additive supply fine depending on the position of the valve.

8. The spinning unit according to claim 7, wherein the valve is connected to a control mechanism designed to keep the valve, during spinning operation of the spinning unit, in a first valve position in which the additive duct is fluidically connected to the additive supply line, and to keep the valve, during a piecing process of the spinning unit, in a second valve position in which the additive duct is fluidically connected to the compressed air line.

9. A process for operating an air jet spinning machine with at least one spinning unit having a spinning nozzle, comprising:

feeding a fiber strand to the spinning nozzle via an inlet while the spinning unit is operated;

imparting a twist to the fiber strand proximate to a yarn forming element that protrudes into a vortex chamber of the spinning nozzle, wherein a yarn is formed from the fiber strand and exits the spinning nozzle through a draw-off channel of the yarn forming element;

with an additive supply, feeding an additive to the spinning nozzle while the spinning unit is operated; and wherein the additive is fed through an additive duct defined in the yarn forming element and is delivered in one or both of the draw-off channel or the vortex chamber, the additive duct oriented obliquely relative to a transport direction of the yarn through the draw off channel.

10. The process according to claim 9, wherein an additive is delivered through the additive duct during a spinning process of the spinning unit, and compressed air is delivered through the additive duct during a piecing process of the spinning unit.

11. The process according to claim 10, wherein the additive duct is fluidically connected to an additive supply line and a compressed air line, and a valve is assigned to one of the additive supply line or the compressed air line, wherein the valve is controlled in a first position during the spinning process in which the additive duct is connected to the additive supply line, and wherein the valve is controlled in a second position during the piecing process in which the additive duct is connected to the compressed air line.

12. The process according to claim 9, wherein volumetric or mass flow of the additive delivered via the additive duct is regulated with a dosing device.

13. The process according to claim 12, wherein the volumetric flow of the delivered additive reaches a rate between 0.001 mlmL/min and 7.0 mL/min, or mass flow of the delivered additive reaches a rate between 0.001 g/min and 7.0 g/min.

14. The process according to claim 13, wherein the volumetric flow of the additive delivered while the spinning unit is operating in a spinning process reaches a rate between 0.001 mL/min and 1.5 mL/min, and the volumetric flow of the additive added while the spinning unit is being cleaned reaches a rate between 2.0 mL/min and 7.0 mL/min.

15. The process according to claim 13, wherein the mass flow of the additive delivered while the spinning unit is operating in a spinning process reaches a rate between 0.001 g/min and 1.5 g/min, and the mass flow of the additives added while the spinning unit is being cleaned reaches a rate between 2.0 g/min and 7.0 g/min.

* * * * *